US007100897B2

(12) United States Patent
Ha

(10) Patent No.: US 7,100,897 B2
(45) Date of Patent: Sep. 5, 2006

(54) HYDRAULIC JACK

(76) Inventor: Tae-Hong Ha, 457-4, Jangan-3 Dong, Dongdaemun-Gu, Seoul 130-103 (KR)

( * ) Notice: Subject to any disclaimer, the term of this patent is extended or adjusted under 35 U.S.C. 154(b) by 161 days.

(21) Appl. No.: 10/476,253

(22) PCT Filed: May 2, 2002

(86) PCT No.: PCT/KR02/00819

§ 371 (c)(1),
(2), (4) Date: Oct. 30, 2003

(87) PCT Pub. No.: WO02/088016

PCT Pub. Date: Nov. 7, 2002

(65) Prior Publication Data

US 2004/0129927 A1 Jul. 8, 2004

(30) Foreign Application Priority Data

May 2, 2001 (KR) ..... 2001-23822

(51) Int. Cl.
*B66F 3/24* (2006.01)

(52) U.S. Cl. ..... 254/93 R; 254/93 H; 254/8 B

(58) Field of Classification Search ..... 254/93 R, 254/93 H, 8 B; 91/412; 60/477, 479, 481, 60/482

See application file for complete search history.

(56) References Cited

U.S. PATENT DOCUMENTS 3,782,689 A * 1/1974 Barosko ..... 254/93 R
4,050,674 A 9/1977 Robbins et al.
4,174,095 A 11/1979 Chipman
4,330,104 A 5/1982 Klok
4,703,916 A 11/1987 Hung
5,542,252 A 8/1996 Hung
5,755,099 A * 5/1998 Hung ..... 60/479

FOREIGN PATENT DOCUMENTS

JP 06-286984 A 10/1994
JP 12-198686 A 7/2000

* cited by examiner

*Primary Examiner*—Robert C. Watson
(74) *Attorney, Agent, or Firm*—Stites & Harbison PLLC; Douglas E. Jackson

(57) ABSTRACT

Disclosed is a jack lever, in which oil is pumped by piston (10) to move a cylinder (20) faster, vacuum being created at a lower portion of the cylinder (20) moving up, oil in an oil tank (101) being then flowed in the lower portion through an oil suction channel to make the cylinder move up faster. If the cylinder (20) moves upward to push up a work piece, load is exerted into the cylinder (20), so making the piston (10) pumping oil stronger, the oil opening a check ball (15*a*) mounted on a bypass channel (15) by the pumping and being supplied to the lower portion of the cylinder (20) to move the cylinder up. At this time, the cylinder (20) moves slower but increases ascending force, thus requiring small power to manipulate a jack lever (not shown) pumping the piston (10).

19 Claims, 11 Drawing Sheets

HYDRAULIC JACK

TECHNICAL FIELD

The present invention relates to a hydraulic jack for lifting various work pieces such as a vehicle.

BACKGROUND ART

Generally, a jack is convenient to carry owing to its small volume and frequently used to lift a vehicle body itself for changing a tire or repairing the vehicle. A lifter is used to lift rather bigger work piece such as from a compact car till 8-ton dump, so having large volume and heavy weight not to be carried. The lifter is usually used in a maintenance station.

Such a conventional hydraulic jack or lifter has an advantage of easily safely lifting a large object with a relative lower force. The conventional hydraulic jack or lifter needs to pump oil by reciprocate a jack lever or handle like levering in order to lift a work piece to a desired height. In other words, there is an inconvenience to manipulate the handle repeatedly till contacting to a bottom of the vehicle body.

The conventional hydraulic jack or lifter is also unhandy since it requires so much strength to manipulate the lever due to load of a lifted object. If the jack or lifter is moved utmost, the jack does not move upward and the jack lever is also not manipulated any more. In addition, excessive load or hydraulic pressure inside the jack or lifter may cause breakage of a sealing such as O-ring or gasket, so leakage of the oil.

DISCLOSURE OF INVENTION

The present invention is designed to solve such problems of the prior art, and an object of the invention is to provide a hydraulic jack, which moves upward rapidly until a jack or lifter contacts with a bottom of a work piece, but strengthens lifting force rather than speed after the jack or lifter contacts the bottom.

Another object of the present invention is to provide a hydraulic jack, in which the output of a jack is improved as well as less power is needed to manipulate a jack lever.

Still another object of the present invention is to provide an improved jack, which eliminates excessive pressure caused by excessive load, or when a load of an object is too big for the jack to lift, by automatically discharging oil to an oil tank, thus protects the jack and prevents immoderate lifting and thus possibility of accident in advance.

Further object of the present invention is to provide a hydraulic jack having improved output so as to be employed in a broad range from small work pieces to large objects, and a lifter using the hydraulic jack.

The present invention therefore provides the following technical solutions: (i) moving rapid till reaching a bottom of a work piece; (ii) stably lifting the work piece at a low speed when reaching the bottom of the work piece and substantially lifting up the work piece; (iii) capable of manipulating a jack lever of heavy load with a small power; (iv) strengthening output of the jack; and (v) protecting the jack by sending hydraulic pressure back to an oil tank in case of excessive load and preventing possibility of accident in advance by designing the jack not to compulsorily lift an object with load exceeding the jack capacity.

BRIEF DESCRIPTION OF THE DRAWINGS

These and other features, aspects, and advantages of preferred embodiments of the present invention will be more fully described in the following detailed description, taken accompanying drawings. In the drawings:

FIGS. 4*a* and 4*b* are enlarged sectional views showing A portion of FIG. 3, in which FIG. 4*a* shows a retreat state of a check ball by hydraulic pressure, while FIG. 4*b* shows a retreat state of a pilot;

BEST MODES FOR CARRYING OUT THE INVENTION

Figure 1:
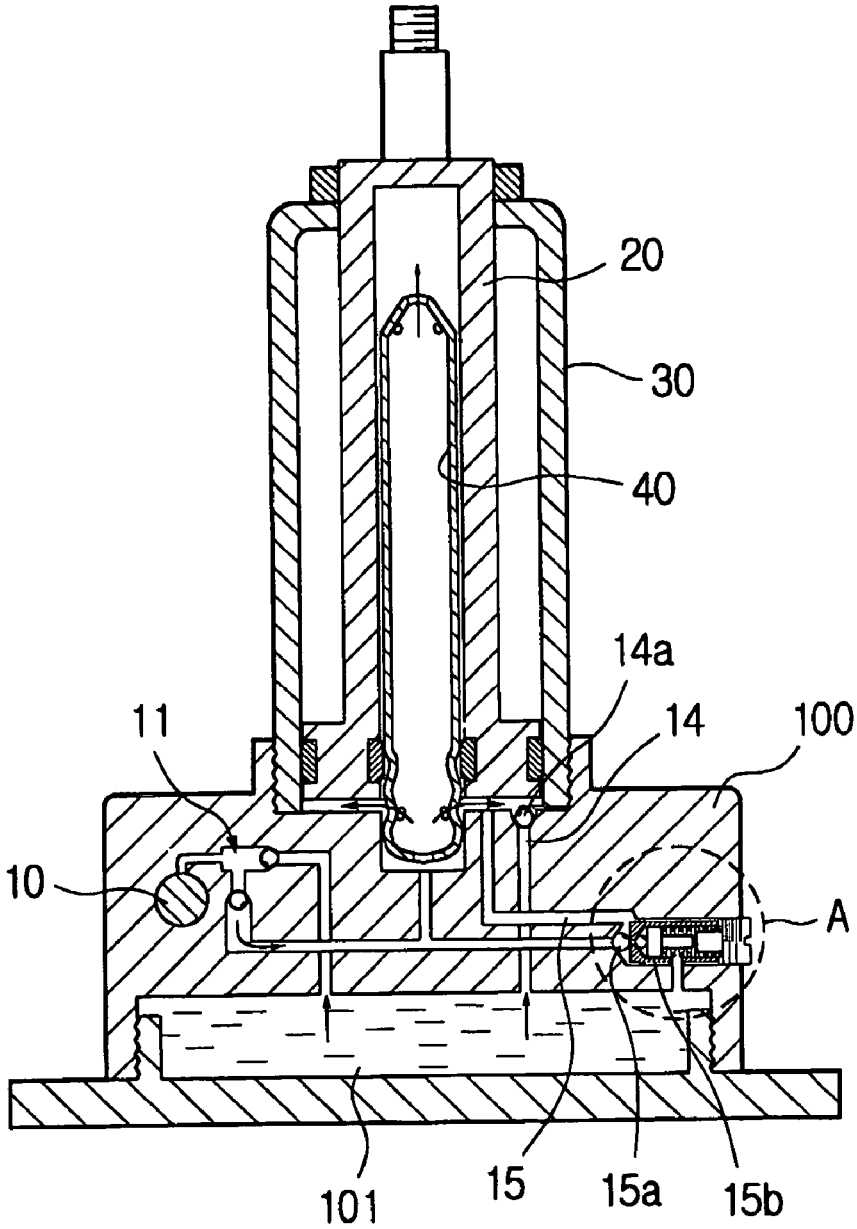
FIG. 1 is a sectional view exemplarily showing a preferred embodiment of the present invention.
Figure 2:
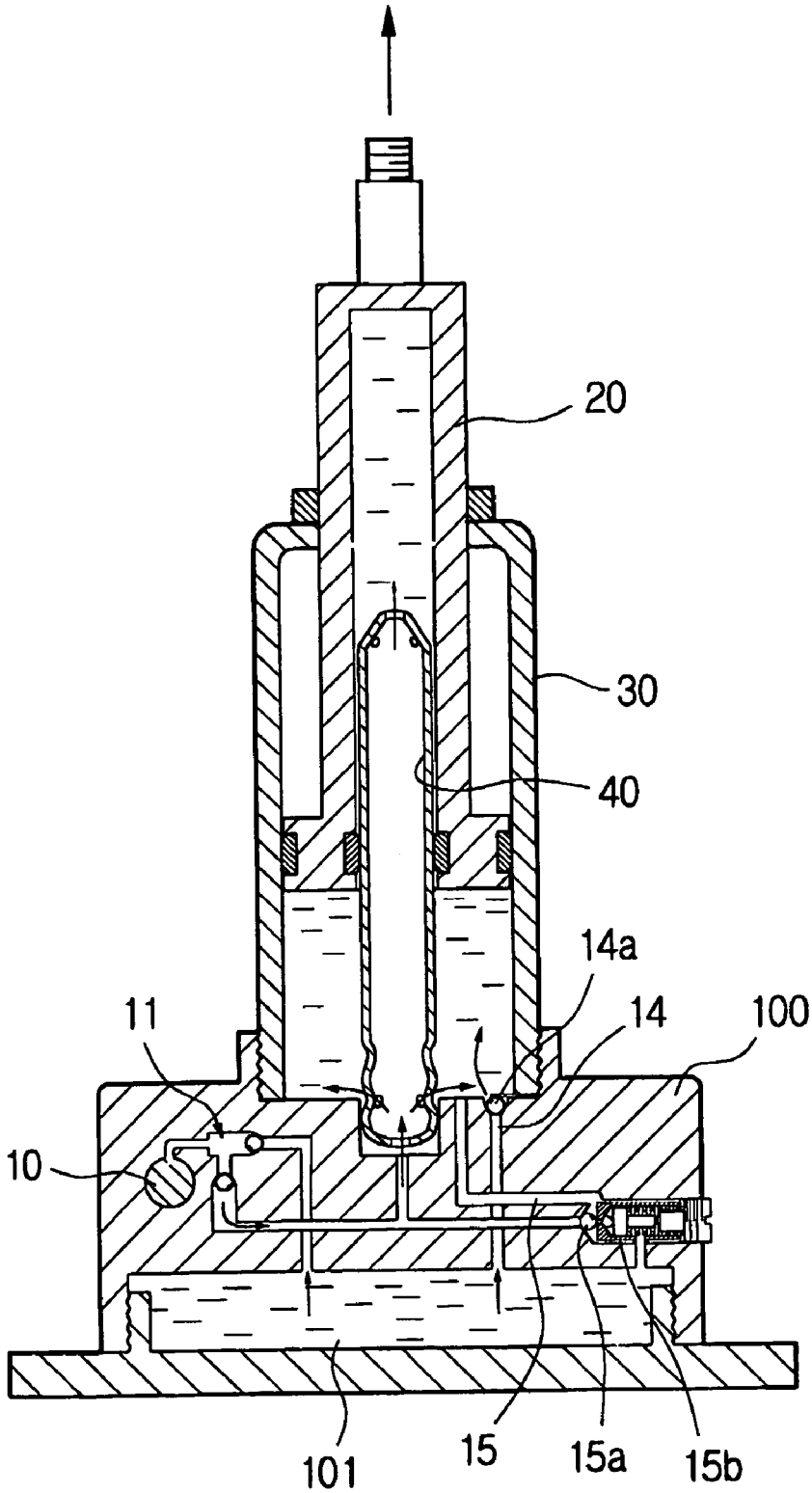
FIG. 2 is a sectional view, similar to FIG. 1, showing an operational state of a hydraulic jack.
Figure 3:
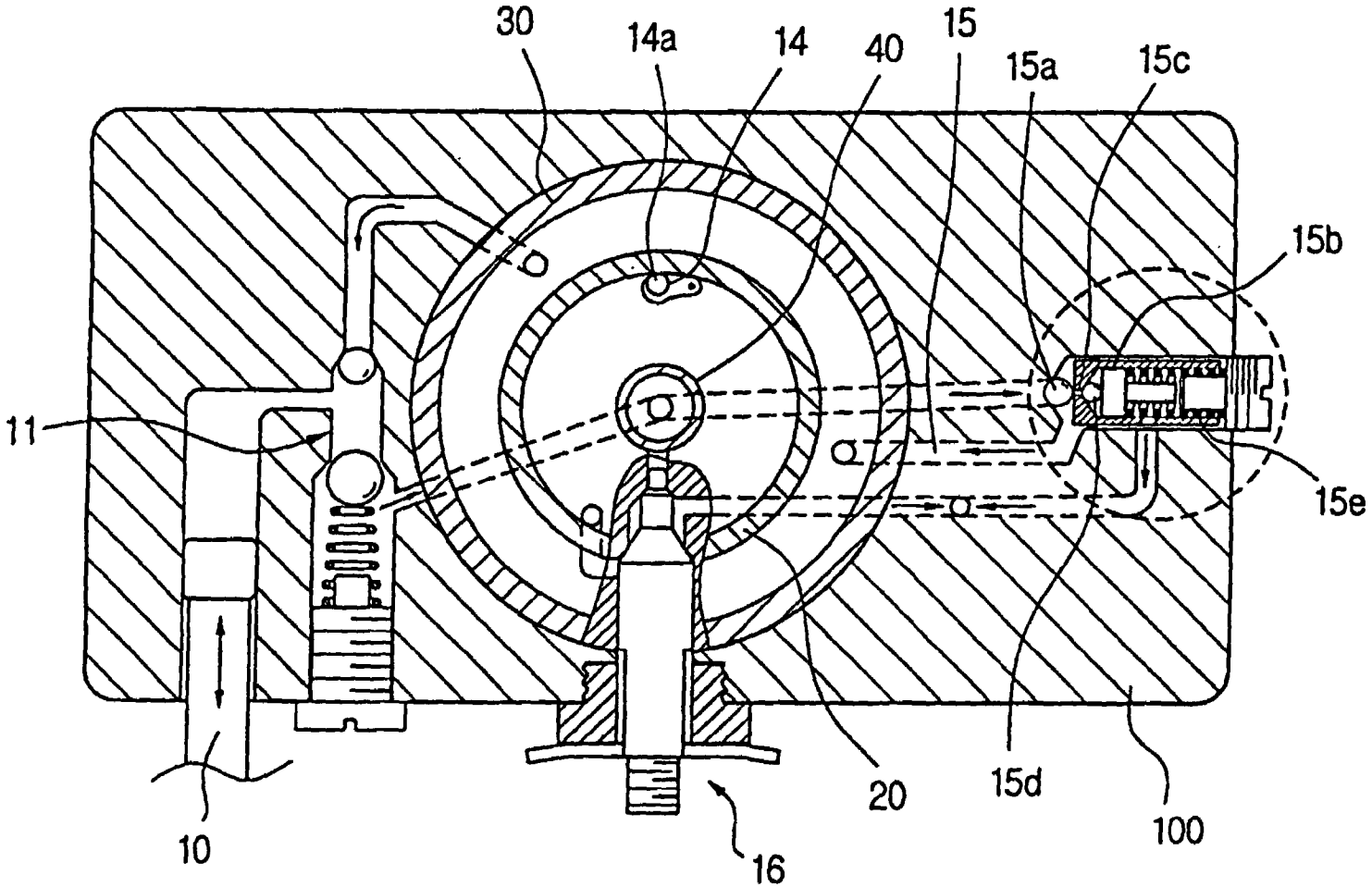
FIG. 3 is a horizontal sectional view showing essential parts of FIG. 1.

Hereinafter, preferred embodiments of the present invention will be described in detail with reference to the accompanying drawings.

A hydraulic jack of the present invention includes a piston 10 having an oil tank 101 and a first check valve 11 combined to a jack lever for pumping oil in the oil tank 101 so that pumped oil does not return to the oil tank 101; an outer barrel 30 for supporting a cylinder 20 to be vertically movable, the outer barrel 30 being sealed by a sealing member having an injection tube 40 to supply into the cylinder 20 the oil pumped by the piston 10; an oil suction channel 14 having a check ball 14*a*, which is communicated with the oil tank 101 when the cylinder 20 moves upward by hydraulic pressure of the oil injected through the first check valve 11 so that the oil is directly flowed in a lower portion of the cylinder 20, thus supplying oil to the cylinder 20 in addition to the pumped oil so as to make the cylinder 20 move faster; a bypass channel 15 for flowing the hydraulic pressure into the lower portion of the cylinder 20 when a predetermined load of a work piece is exerted to a free end of the cylinder 20 to make the check ball 15*a* open so that the cylinder 20 moves slower; and a manifold housing 100 having an openable hydraulic pressure eliminating valve 16 communicated with inside of the cylinder 20 and the injection tube 40 or the lower portion of the cylinder 20 for eliminating the hydraulic pressure by discharging the hydraulic pressure to the oil tank 101.

The hydraulic jack of the present invention may make the cylinder 20 move upward rapidly by means of flowing oil in the cylinder 20 as well as the lower portion of the cylinder 20, in other words by pumping oil by the piston 10 into the cylinder 20 as well as sucking the oil in the oil tank 101 through the oil suction channel 14 into the lower portion of the cylinder 20 using vacuum pressure instantaneously generated when the cylinder 20 moves up.

And, if the cylinder 20 moves up to push the work piece upward, the piston 20 should be more strengthened since a load is exerted into the cylinder 20. Thus, the oil opens the check ball 15*a* mounted on the bypass channel 15 by using the pumping pressure so that the oil makes a detour toward the lower portion of the cylinder 20, thus moves the cylinder upward.

At this time, the cylinder 20 gets having stronger force upward in spite of lower speed. In addition, a jack lever (not shown) pumping the piston 10 can be manipulated with relatively less power.

Though there is needed a relatively greater pumping pressure to move the cylinder upward when a very big load is exerted inside the cylinder, the hydraulic jack of the present invention as described above solves the problem that the jack lever is difficult to manipulate (reciprocation of the piston). In addition, to solve a problem that, if the piston 10 is operated when the cylinder 20 is sufficiently moved upward to the top, a sealing member prepared between the cylinder 20 and the injection tube 40 can be broken down due to the pumping pressure, the hydraulic jack of the present invention may an automatic hydraulic pressure save means.

Figure 4A:
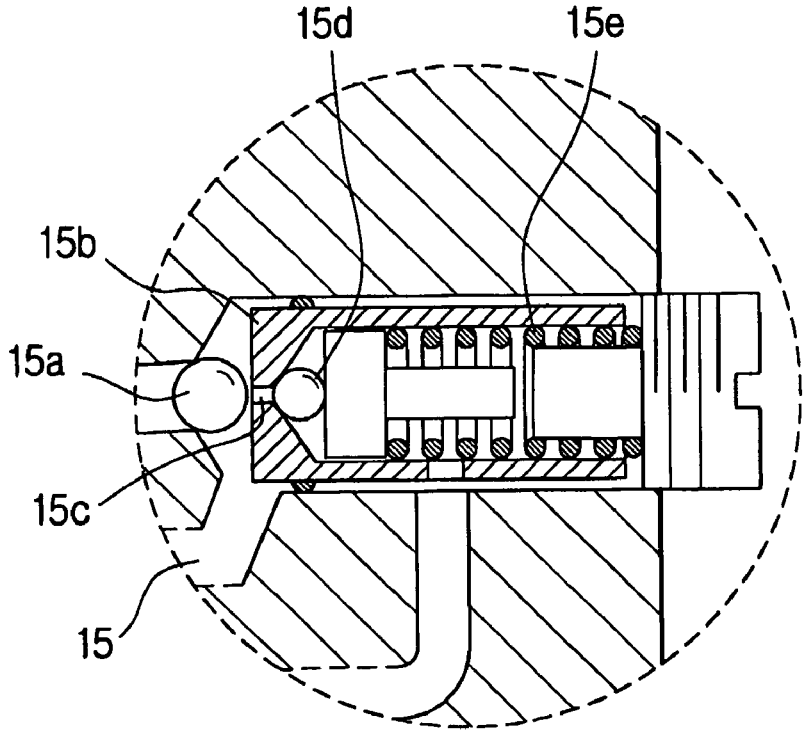
Figure 4B:
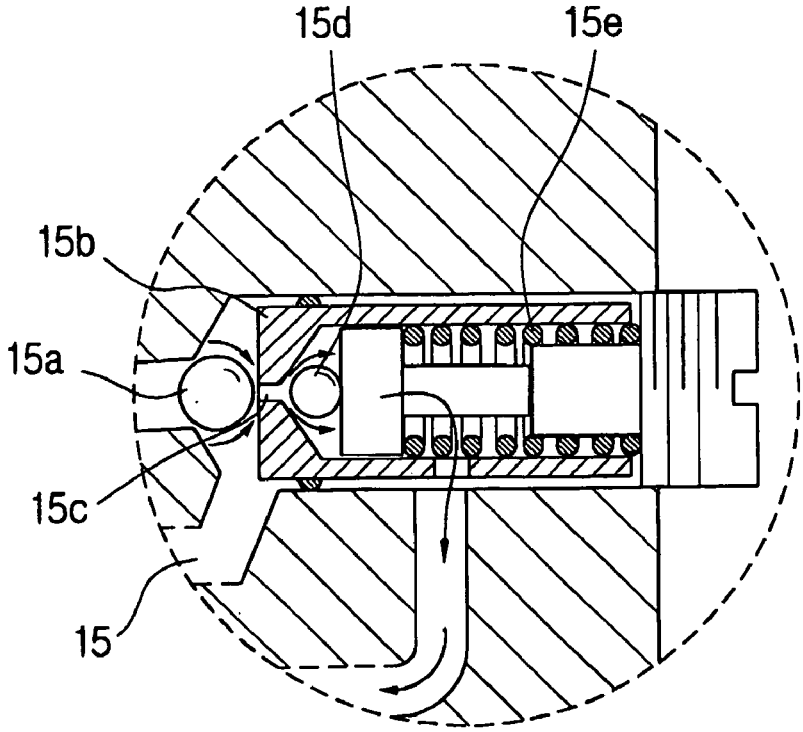
Figure 5:
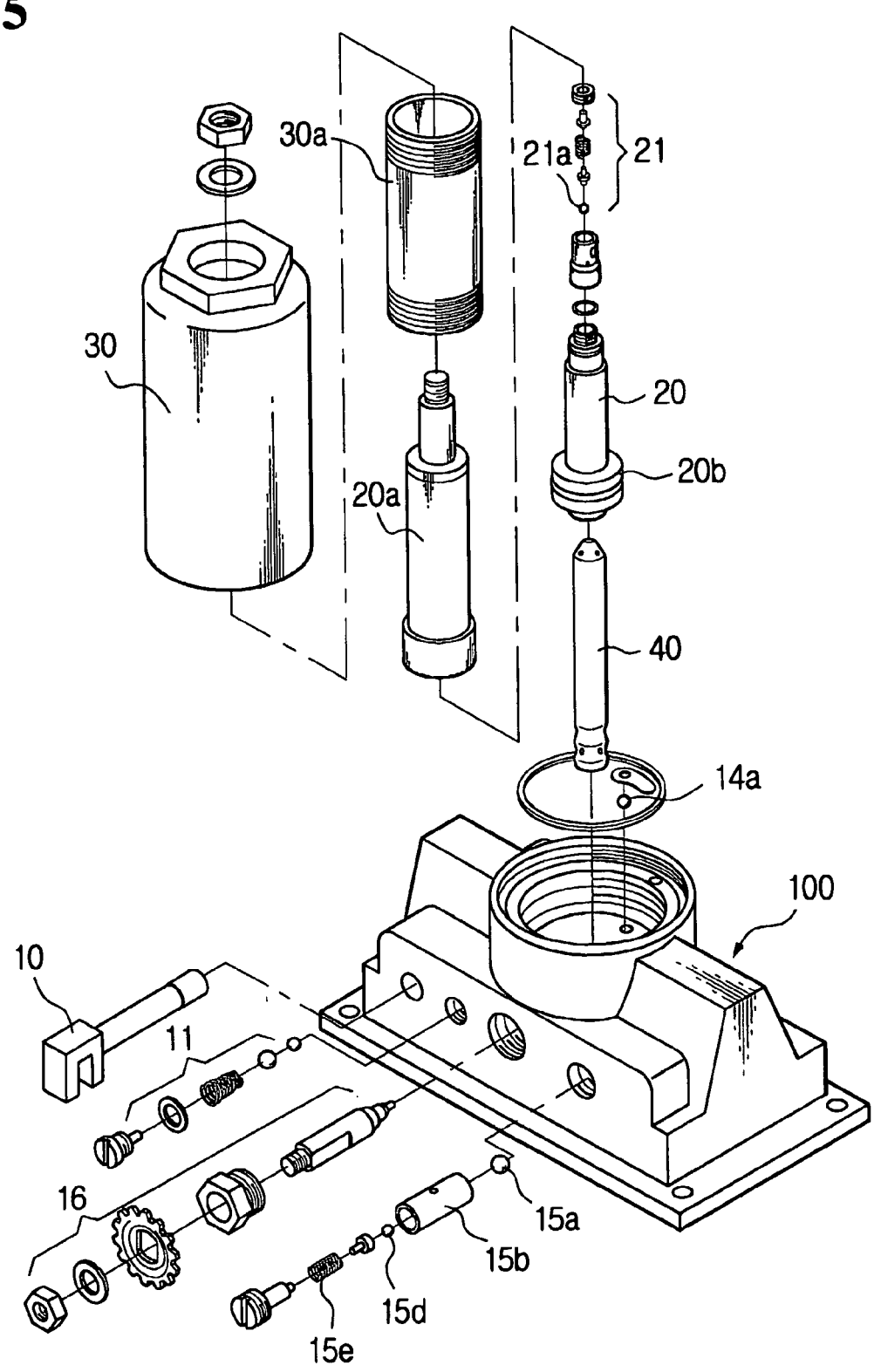
FIG. 5 is an exploded perspective view showing a jack according to a modified embodiment of the present invention.
Figure 6:
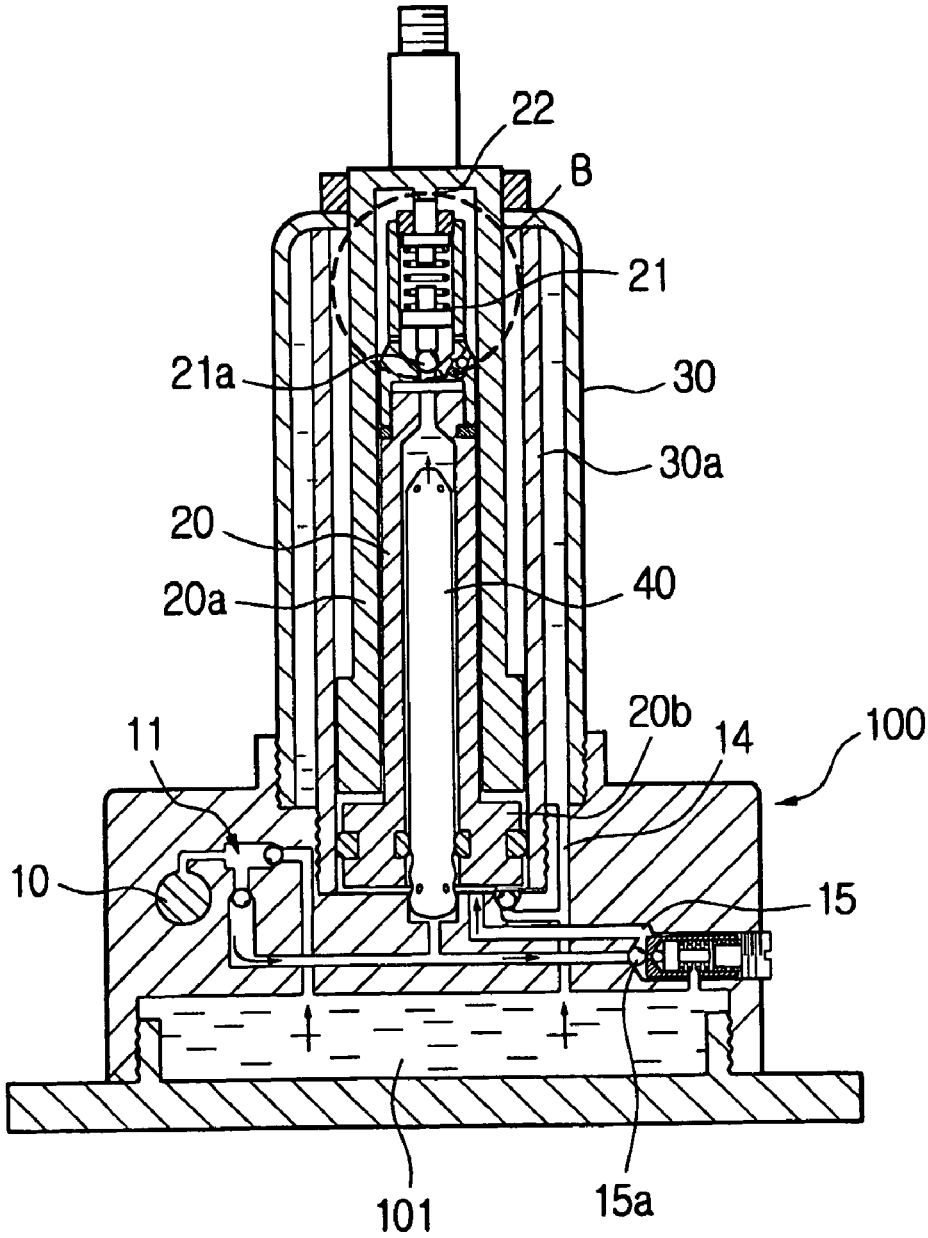
FIG. 6 is a vertical sectional view showing essential parts of FIG. 5.

As an example of the automatic hydraulic pressure save means, as shown in FIG. 4*b*, there is formed a through hole 15*c* communicated with inside thereof at an end of a pilot 15*b* pressing a rear of the check ball 15*a* mounted on the channel 15, and another check ball 15*d* is installed in the through hole 15*c* so as to block the through hole 15*c* by elasticity of a spring 15*e*. When the check ball 15*d* moves back, the oil flowed in the through hole 15*c* can be moved into the oil tank 101.

The save means is operated as follows. If the cylinder 20 pushes up the work piece to exert excessive load over predetermined pressure, the oil pumped by pressure over the load retreats the pilot 15*b*, which is elastically pushing the check ball 15*a* of the bypass channel 15. Thus, the oil detours to the lower portion of the cylinder so that the cylinder 20 moves upward slowly. Then, if the load increases more or the cylinder is moved to the top, not capable of ascending, the end of the pilot 15*b* moves back by the pumped oil pressure. At this time, the check ball 15*a* and the pilot 15*b* get spaced apart so that the through hole 15*c* becomes exposed.

Thus, while the check ball 15*d* retreats with overcoming elasticity of the spring 15*e* by the oil flowed in the through hole 15*c* of the pilot 15*b*, the oil gets induced in the through hole 15*c*. At this time, while the oil, induced in the through hole 15*b* when the pilot 15*b* is communicated with the oil tank 101 by retreat of the pilot 15*b*, returns into the oil tank 101, the excessive hydraulic pressure exerted in the jack is automatically eliminated.

The spring 15*e* is retracted when the load exerted to the cylinder 20 is at least more than the elasticity of the spring 15*e*. For example, in case of a hydraulic jack for a compact vehicle, the spring 15*e* is retracted when the exerted load is over about 1.5 kg.

If the hydraulic jack experiences more than about 1.5 kg of load for example, the oil returns to the oil tank 101 so that the cylinder 20 moves downward with the oil therein being eliminated. The capacity of the jack is increased or decreased when the elasticity of the spring 15*e* is increased or decreased.

Thus, the hydraulic jack can be protected against the exerted load exceeding the capacity of the hydraulic jack, and falling accident caused by overwork lifting can be prevented in advance.

As described above, it would be understood that the capacity of the hydraulic jack of the present invention can be set in broad range by setting elasticity of the springs as desired.

As another embodiment, the hydraulic jack of the present invention can be modified so that the cylinder 20 has at least two stages, which can be piled each other.

In this modified embodiment, as shown in FIGS. 5 to 9, the cylinder 20 is divided to have additional outer cylinder 20*a*, which is slidably combined to the inner cylinder 20. At this time, a flange 20*b* is formed at a lower end of the inner cylinder 20 to push the outer cylinder 20*a* upward. And, there may be prepared a check valve assembly 21 between the inner cylinder 20 and the outer cylinder 20*a*. The reference numeral 21*c* denotes a fine channel used for eliminating oil in the outer cylinder 20*a*, and has an one-directional check valve. Reference numeral 30*a* denotes an inner wall partitioned to configure the oil tank 101 in the outer barrel. This oil tank is communicated with the oil tank disposed below.

Figure 7:
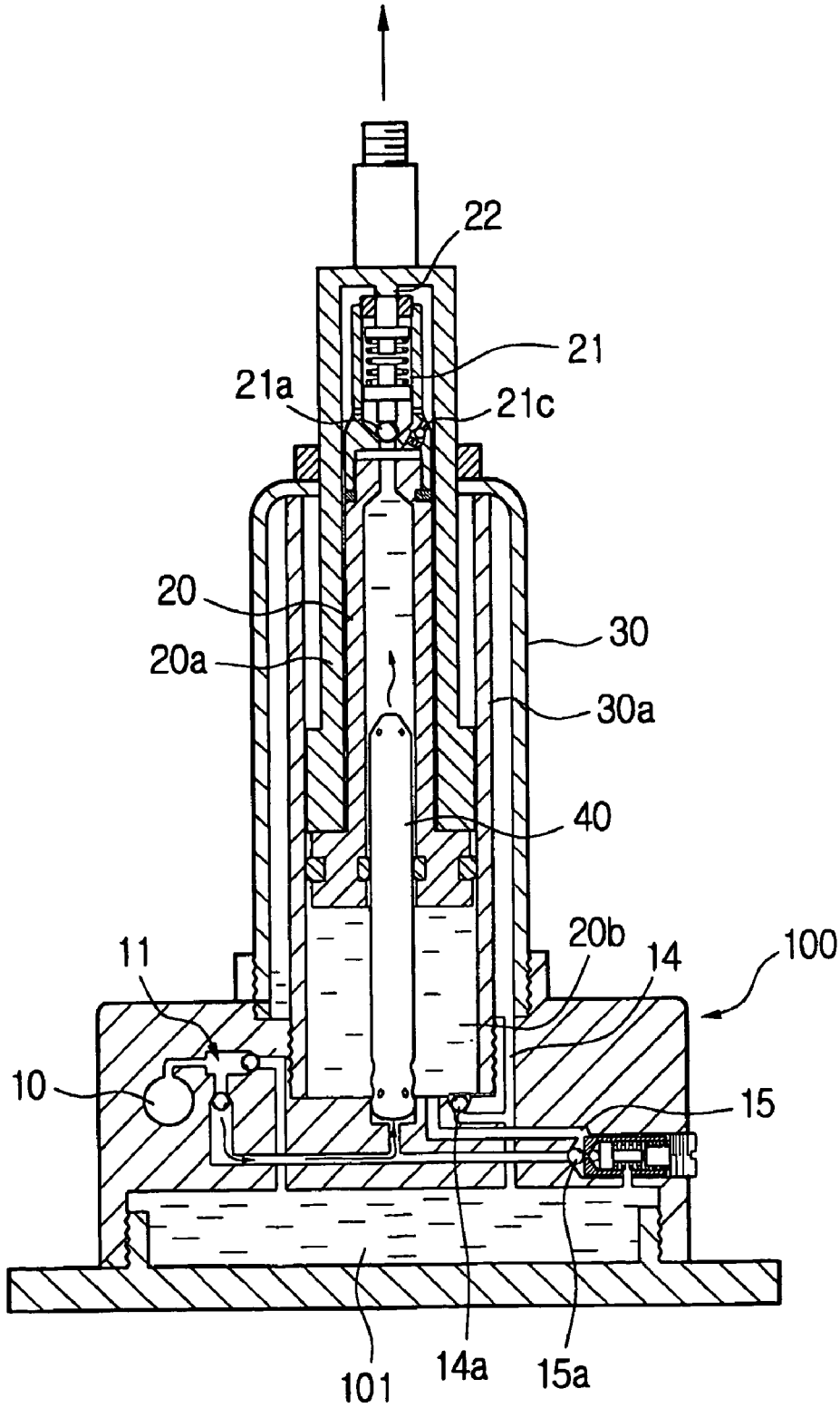
FIG. 7 is a sectional view, similar to FIG. 6, showing operation of a cylinder.
Figure 8:
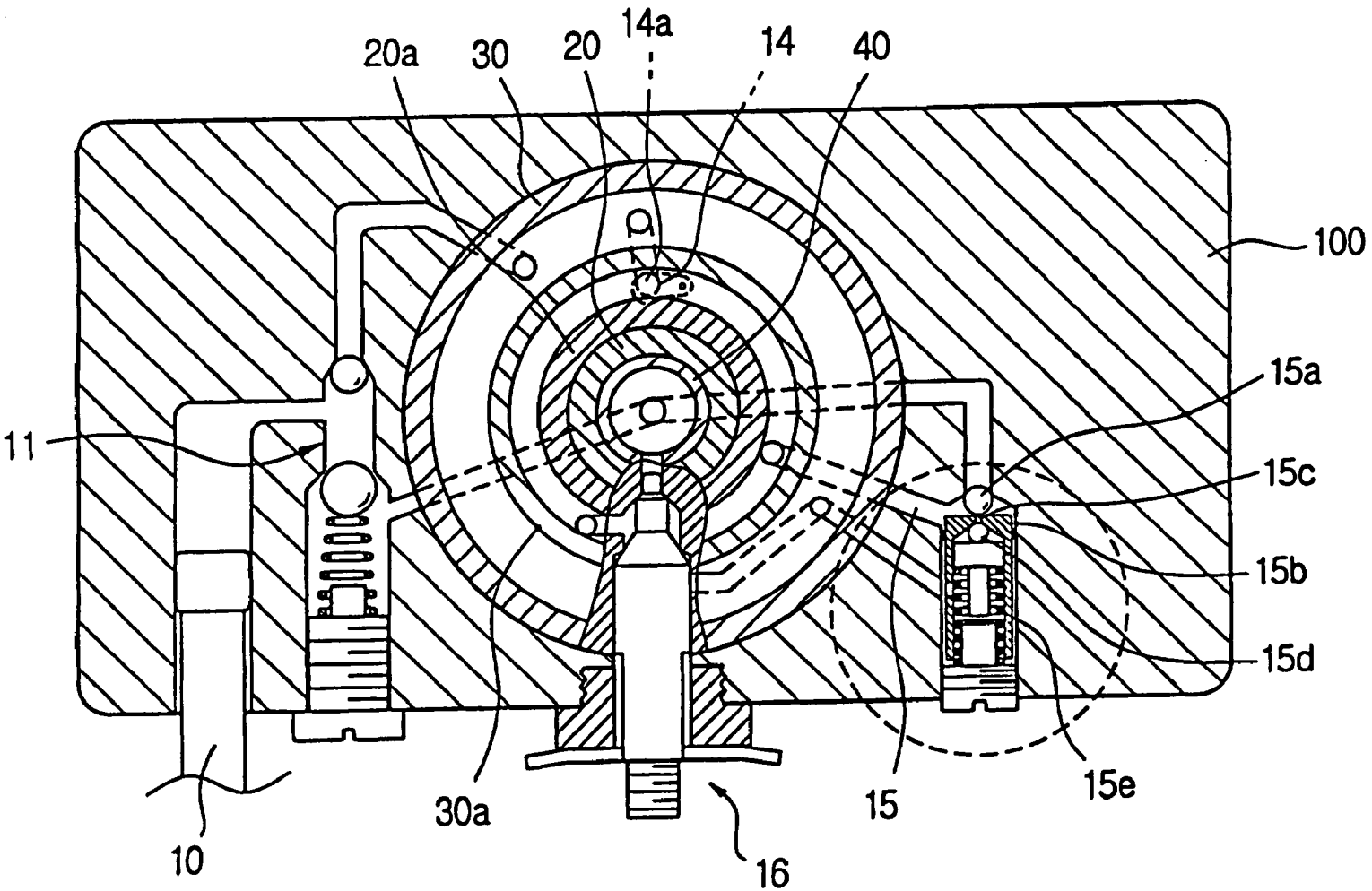
FIG. 8 is a horizontal sectional view showing essential parts of a hydraulic jack shown in FIG. 5.

In this modification, the inner cylinder 20 initially moves up when the pumped oil is flowed in the inner cylinder 20, as shown in FIG. 7, and then the flange 20*b* pushes up the outer cylinder 20*a*. As the outer cylinder 20*a* moves upward, an end of the outer cylinder 20*a* contacts with the work piece. Thus, the load of the work piece is exerted on the outer cylinder 20*a* to pump oil stronger. Then, the check ball 21*a* retreats by the pumping pressure so that fluid can be flowed in the channel 21*b*, so moving the outer cylinder 20*a* upward. Since the outer cylinder 20*a* has an inner volume less than that of the inner cylinder 20, the outer cylinder 20*a* moves faster for same pumping.

Figure 9A:
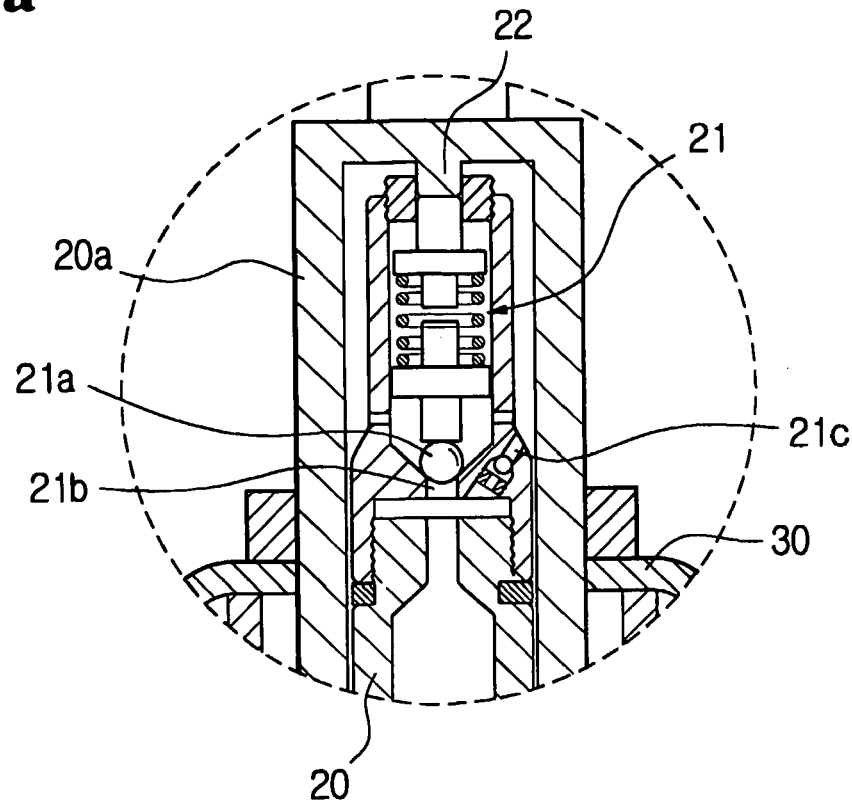
FIGS. 9*a* and 9*b* are enlarged views of B portion of FIG. 6.
Figure 9B:
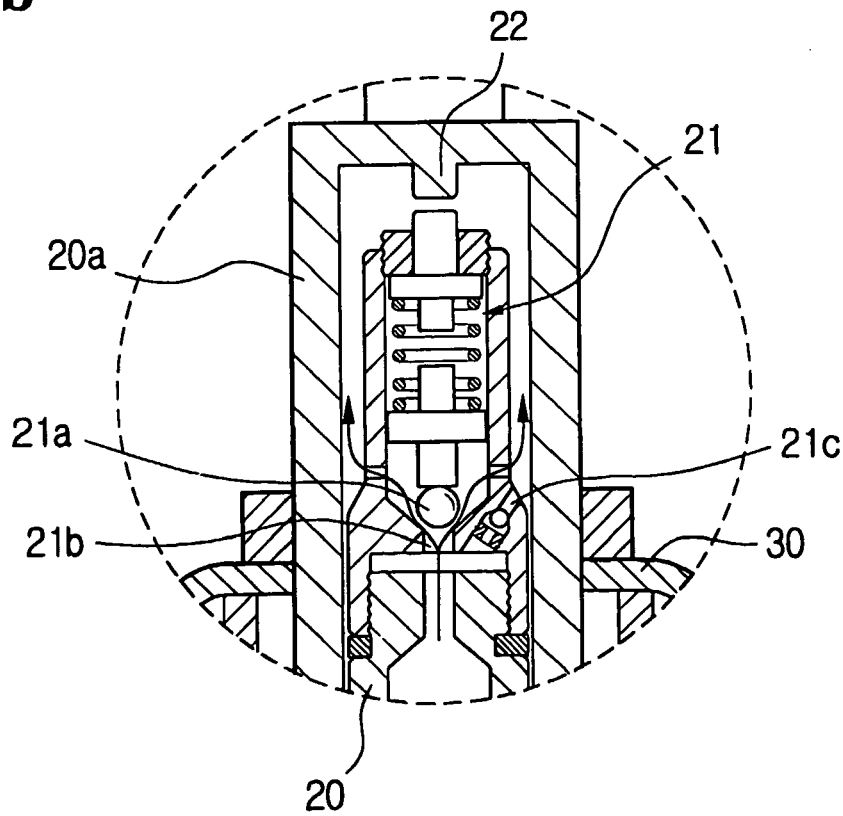

In addition, the valve assembly has a protrusion 22 formed at an inner side of the outer cylinder 20*a* to press a rear of the check valve 21 when the outer cylinder 20*a* moves down, as shown in FIGS. 9*a* and 9*b*. Thus, the inner cylinder 20 initially moves up firstly, and when a predetermined load is exerted to the cylinder, the outer cylinder 20*a* is moved up with the check ball 21*a* being open, by which the cylinder can move up with relatively smaller power. Thus, since the hydraulic jack can rapidly move up to the bottom of the work piece, there is no need to manipulate the jack lever.

Figure 10:
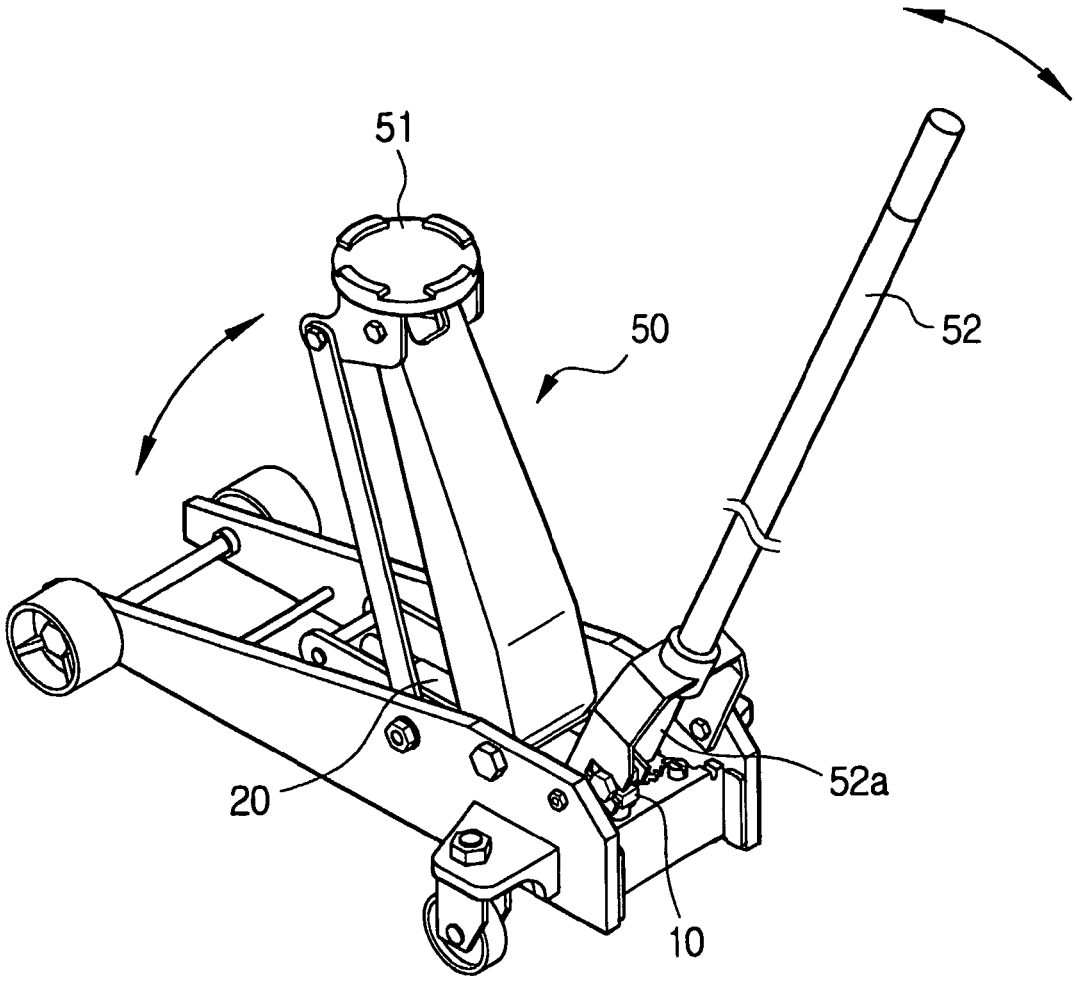
FIG. 10 is a perspective view showing an example of lifter employing the hydraulic jack according to the present invention.
Figure 11:
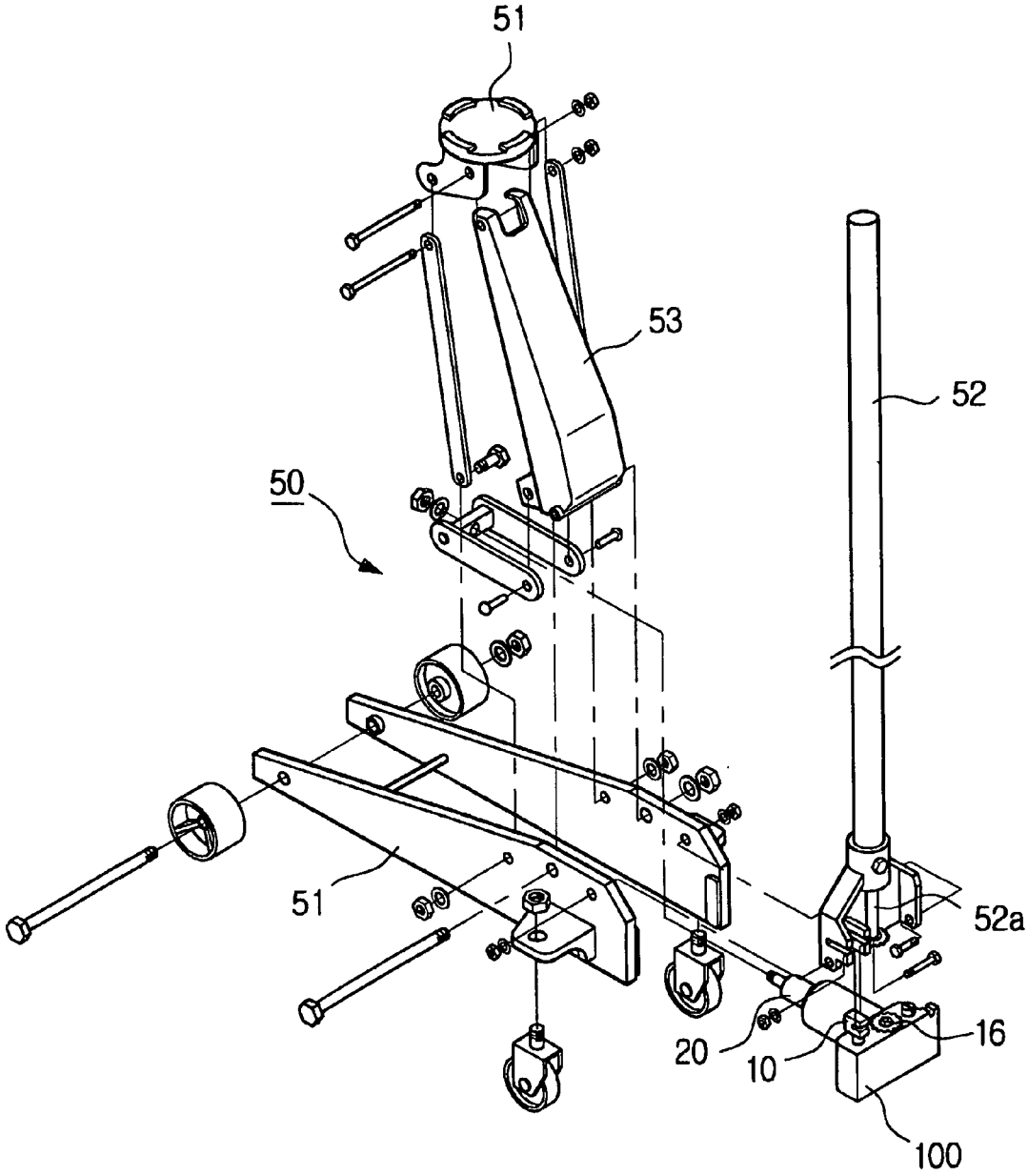
FIG. 11 is an exploded view of the lifter shown in FIG. 10.

FIGS. 10 and 11 are a perspective view and an exploded perspective view showing an example that the hydraulic jack of the present invention is adopted to a lifter, respectively. Referring to FIGS. 10 and 11, a free end of the cylinder 20 is pivotably combined to an arm 53, which is also pivoted. Thus, the arm rotates on a pivot axis depending on length of the cylinder 20 so as to adjust height of a ram 51. Therefore, owing to power caused by the ascent of ram 51, the work piece can be lifted.

At this time, the piston 10 is linked to the arm 53 so as to be work together when manipulating the handle 52 up or down. Also, the piston 10 can be manipulated by rotating a pressure eliminating shaft 52*a* extended into the handle 52 for connection to a pressure eliminating valve 16.

As described above, the hydraulic jack of the present invention can be applied to various fields such as a lifting device when connecting jacks for bridge upper plate to supports of buildings or tower crane, in addition to the lifting device using length of the hydraulic length.

By using the present invention, work efficiency and convenience can be obtained since light and heavy objects can be used at the same time. Additionally, in case of using the device such as a lifter to which the hydraulic jack of the present invention is applied, a worker may make the cylinder move faster to lift a light object, which makes the work convenient and rapid. Moreover, because the oil pressure is adjustable depending on load and position of the work piece on the cylinder, the work can be more stable.

What is claimed is:

1. A hydraulic jack comprising:

a piston which is in communication with an oil tank and a first check valve and which is operatively associated with a jack lever for creating a hydraulic pressure and hence for pumping oil from the oil tank;

an outer barrel upstanding from a base for supporting a cylinder therein to be vertically movable relative to the outer barrel, the outer barrel being sealed to the cylinder by a sealing member so as to define a lower portion of the cylinder therebelow;

an injection tube which is upstanding from the base and which extends into an inside of the cylinder, the injection tube supplying into the inside of the cylinder the oil pumped by the piston;

an oil suction channel having a check ball therein, the oil suction channel being communicated with the oil tank such that, when the cylinder moves upward by the hydraulic pressure of the oil pumped by the piston into the inside of the cylinder and a predetermined load is not exerted on a free end of the cylinder, oil from the oil tank is directly flowed by suction to the lower portion of the cylinder, thus supplying oil to the lower portion of the cylinder directly from the oil tank so as to make the cylinder move upwards at a fast speed;

a bypass channel for bypassing the injection tube and flowing the oil pumped by the piston directly to the lower portion of the cylinder, the bypass channel including a check ball therein which opens only when the predetermined load of a work piece is exerted on the free end of the cylinder, so that the cylinder then moves upwards at a slow speed which is slower than the fast speed when no load was exerted and the check ball was closed; and a manifold housing having an openable hydraulic pressure eliminating valve communicated fluidly with the inside of the cylinder, the injection tube, and the lower portion of the cylinder, for eliminating the hydraulic pressure by discharging oil to the oil tank;

wherein the cylinder includes (a) an inner cylinder body and an outer cylinder body, said inner cylinder body being movably received in said outer cylinder body and having a flange formed at a lower end thereof to push the outer cylinder body upward together with the inner cylinder body, and (b) a fine channel which is formed between the inner and outer cylinder bodies and which opens to communicate the hydraulic pressure in the injection tube to the volume between the inner and outer cylinder bodies; and wherein a protrusion is formed at an inner side of the free end of the outer cylinder body to press a second check valve in the fine channel, the protrusion being spaced apart from a second check ball of the second check valve so that the outer cylinder body moves upward by a predetermined load after the inner cylinder body initially moves upward.

2. A hydraulic jack according to claim 1, further comprising an automatic hydraulic pressure save means located in the bypass channel for automatically sending the oil back to the oil tank when an excessive load is exerted on the free end of the cylinder.

3. A hydraulic jack according to claim 2, wherein the automatic hydraulic pressure save means has a through hole communicated with an inside thereof at an end of a pilot pressing a rear of the check ball mounted on a channel, and another check ball in the through hole so as to block the through hole by elasticity of a spring, the oil flowed in the through hole being movable into the oil tank when the another check ball moves back.

4. A hydraulic jack according to claim 1, wherein, when no predetermined load is exerted on the free end of the cylinder, the injection tube freely supplies oil pumped by the piston (a) primarily into the inside of the cylinder and (b) secondarily to the lower portion of the cylinder.

5. A hydraulic jack according to claim 4, wherein the injection tube is open to the inside of the cylinder and to the lower portion of the cylinder.

6. A hydraulic jack comprising:

a piston which is in communication with an oil tank and a first check valve and which is operatively associated with a jack lever for creating a hydraulic pressure and hence for pumping oil from the oil tank;

an outer barrel upstanding from a base;

an outer cylinder supported in the outer barrel to be vertically movable relative to the outer barrel;

an inner cylinder movably supported by and received in said outer cylinder and having a flange formed at a lower end thereof to push the outer cylinder upward together with the inner cylinder, a sealing member which seals the flange to the outer barrel so as to define a lower portion of the inner cylinder therebelow, and a fine channel which is formed between the inner and outer cylinders and which channel opens into a volume between the inner and outer cylinders only when a predetermined load is exerted on a free end of the outer cylinder;

an injection tube which is upstanding from the base and which extends into an inside of the inner cylinder, the injection tube supplying into the inside of the inner cylinder the oil pumped by the piston;

an oil suction channel having a check ball therein, the oil suction channel being communicated with the oil tank such that, when the inner and outer cylinders move upwards together by the hydraulic pressure of the oil pumped by the piston into the inside of the inner cylinder and a predetermined load is not exerted on the free end of the outer cylinder, oil from the oil tank is directly flowed by suction to the lower portion of the inner cylinder, thus supplying oil to the lower portion of the inner cylinder directly from the oil tank so as to make the inner and outer cylinders move upwards at a fast speed;

a bypass channel for flowing, when the predetermined load of a work piece is exerted on the free end of the outer cylinder, the oil pumped by the piston a) directly to the lower portion of the inner cylinder, so that the inner cylinder then move upwards at a first slow speed, and b) indirectly through the injection tube and the fine channel to the volume between the inner and outer cylinders to cause the outer cylinder to additionally move upwards relative to the inner cylinder at a second slow speed, the outer cylinder thus moving relative to the outer barrel at a combined speed of the first slow speed and the second slow speed which combined speed is slower than the fast speed when no load was exerted; and a manifold housing having an openable hydraulic pressure eliminating valve communicated fluidly with the inside of the inner cylinder, the injection tube and the lower portion of the inner cylinder, for eliminating the hydraulic pressure by discharging oil to the oil tank; and wherein a protrusion is formed at an inner side of the free end of the outer cylinder to press a second check valve in the fine channel, the protrusion being spaced apart from a second check ball of the second check valve so that the outer cylinder moves upward by a predetermined load after the inner cylinder initially moves upward.

7. A hydraulic jack according to claim 6, further comprising an automatic hydraulic pressure save means located in the bypass channel for automatically sending the oil back to the oil tank when an excessive load is exerted on the free end of the outer cylinder.

8. A hydraulic jack according to claim 7, wherein the automatic hydraulic pressure save means has a through hole communicated with an inside thereof at an end of a pilot pressing a rear of the check ball mounted on a channel, and another check ball in the through hole so as to block the through hole by elasticity of a spring, the oil flowed in the through hole being movable into the oil tank when the another check ball moves back.

9. A hydraulic jack according to claim 6, wherein, when no predetermined load is exerted on the free end of the outer cylinder, the injection tube freely supplies oil pumped by the piston (a) primarily into the inside of the inner cylinder and (b) secondarily to the lower portion of the inner cylinder.

10. A hydraulic jack according to claim 9, wherein the injection tube is open to the inside of the inner cylinder and to the lower portion of the inner cylinder.

11. A hydraulic jack comprising:

a piston which is in communication with an oil tank and a first check valve and which is operatively associated with a jack lever for creating a hydraulic pressure and hence for pumping oil from the oil tank;

an outer barrel upstanding from a base for supporting a cylinder therein to be vertically movable relative to the outer barrel, the outer barrel being sealed to the cylinder by a sealing member so as to define a lower portion of the cylinder therebelow;

an injection tube which is upstanding from the base and which extends into an inside of the cylinder, the injection tube supplying into the inside of the cylinder the oil pumped by the piston;

an oil suction channel having a check ball therein, the oil suction channel being communicated with the oil tank such that, when the cylinder moves upward by the hydraulic pressure of the oil pumped by the piston into the inside of the cylinder and a predetermined load is not exerted on a free end of the cylinder, oil from the oil tank is directly flowed by suction to the lower portion of the cylinder, thus supplying oil to the lower portion of the cylinder directly from the oil tank so as to make the cylinder move upwards at a fast speed;

a bypass channel for bypassing the injection tube and flowing the oil pumped by the piston directly to the lower portion of the cylinder, the bypass channel including a check ball therein which opens only when the predetermined load of a work piece is exerted on the free end of the cylinder, so that the cylinder then moves upwards at a slow speed which is slower than the fast speed when no load was exerted and the check ball was closed; and a manifold housing having an openable hydraulic pressure eliminating valve communicated fluidly with the inside of the cylinder, the injection tube, and the lower portion of the cylinder, for eliminating the hydraulic pressure by discharging oil to the oil tank; and wherein, when no predetermined load is exerted on the free end of the cylinder, the injection tube freely supplies oil pumped by the piston (a) primarily into the inside of the cylinder and (b) secondarily to the lower portion of the cylinder; and wherein the injection tube is open to the inside of the cylinder and to the lower portion of the cylinder.

12. A hydraulic jack according to claim 11, wherein the cylinder includes:

an inner cylinder body and an outer cylinder body, said inner cylinder body being movably received in said outer cylinder body and having a flange formed at a lower end thereof to push the outer cylinder body upward together with the inner cylinder body, and a fine channel which is formed between the inner and outer cylinder bodies and which opens to communicate the hydraulic pressure in the injection tube to the volume between the inner and outer cylinder bodies.

13. A hydraulic jack according to claim 12, wherein a protrusion is formed at an inner side of the free end of the outer cylinder body to press a second check valve in the fine channel, the protrusion being spaced apart from a second check ball of the second check valve so that the outer cylinder body moves upward by a predetermined load after the inner cylinder body initially moves upward.

14. A hydraulic jack according to claim 11, further comprising an automatic hydraulic pressure save means located in the bypass channel for automatically sending the oil back to the oil tank when an excessive load is exerted on the free end of the cylinder.

15. A hydraulic jack according to claim 14, wherein the automatic hydraulic pressure save means has a through hole communicated with an inside thereof at an end of a pilot pressing a rear of the check ball mounted on a channel, and another check ball in the through hole so as to block the through hole by elasticity of a spring, the oil flowed in the through hole being movable into the oil tank when the another check ball moves back.

16. A hydraulic jack comprising:

a piston which is in communication with an oil tank and a first check valve and which is operatively associated with a jack lever for creating a hydraulic pressure and hence for pumping oil from the oil tank;

an outer barrel upstanding from a base;

an outer cylinder supported in the outer barrel to be vertically movable relative to the outer barrel;

an inner cylinder movably supported by and received in said outer cylinder and having a flange formed at a lower end thereof to push the outer cylinder upward together with the inner cylinder, a sealing member which seals the flange to the outer barrel so as to define a lower portion of the inner cylinder therebelow, and a fine channel which is formed between the inner and outer cylinders and which channel opens into a volume between the inner and outer cylinders only when a predetermined load is exerted on a free end of the outer cylinder;

an injection tube which is upstanding from the base and which extends into an inside of the inner cylinder, the injection tube supplying into the inside of the inner cylinder the oil pumped by the piston;

an oil suction channel having a check ball therein, the oil suction channel being communicated with the oil tank such that, when the inner and outer cylinders move upwards together by the hydraulic pressure of the oil pumped by the piston into the inside of the inner cylinder and a predetermined load is not exerted on the free end of the outer cylinder, oil from the oil tank is directly flowed by suction to the lower portion of the inner cylinder, thus supplying oil to the lower portion of the inner cylinder directly from the oil tank so as to make the inner and outer cylinders move upwards at a fast speed;

a bypass channel for flowing, when the predetermined load of a work piece is exerted on the free end of the outer cylinder, the oil pumped by the piston a) directly to the lower portion of the inner cylinder, so that the inner cylinder then move upwards at a first slow speed, and b) indirectly through the injection tube and the fine channel to the volume between the inner and outer cylinders to cause the outer cylinder to additionally move upwards relative to the inner cylinder at a second slow speed, the outer cylinder thus moving relative to the outer barrel at a combined speed of the first slow speed and the second slow speed which combined speed is slower than the fast speed when no load was exerted; and a manifold housing having an openable hydraulic pressure eliminating valve communicated fluidly with the inside of the inner cylinder, the injection tube and the lower portion of the inner cylinder, for eliminating the hydraulic pressure by discharging oil to the oil tank; and wherein, when no predetermined load is exerted on the free end of the outer cylinder, the injection tube freely supplies oil pumped by the piston (a) primarily into the inside of the inner cylinder and (b) secondarily to the lower portion of the inner cylinder; and wherein the injection tube is open to the inside of the inner cylinder and to the lower portion of the inner cylinder.

17. A hydraulic jack according to claim 16, wherein a protrusion is formed at an inner side of the free end of the outer cylinder to press a second check valve in the fine channel, the protrusion being spaced apart from a second check ball of the second check valve so that the outer cylinder moves upward by a predetermined load after the inner cylinder initially moves upward.

18. A hydraulic jack according to claim 16, further comprising an automatic hydraulic pressure save means located in the bypass channel for automatically sending the oil back to the oil tank when an excessive load is exerted on the free end of the cylinder.

19. A hydraulic jack according to claim 18, wherein the automatic hydraulic pressure save means has a through hole communicated with an inside thereof at an end of a pilot pressing a rear of the check ball mounted on a channel, and another check ball in the through hole so as to block the through hole by elasticity of a spring, the oil flowed in the through hole being movable into the oil tank when the another check ball moves back.

* * * * *